US007017210B2

(12) United States Patent
Ooyama et al.

(10) Patent No.: US 7,017,210 B2
(45) Date of Patent: Mar. 28, 2006

(54) RISING-TYPE BED APPARATUS AND MATTRESS

(75) Inventors: Kei Ooyama, Higashiyamato (JP); Takashi Hasegawa, Higashiyamato (JP)

(73) Assignee: France Bed Co., Ltd., Tokyo (JP)

( * ) Notice: Subject to any disclaimer, the term of this patent is extended or adjusted under 35 U.S.C. 154(b) by 0 days.

(21) Appl. No.: 10/944,637

(22) Filed: Sep. 17, 2004

(65) Prior Publication Data

US 2005/0028281 A1 Feb. 10, 2005

Related U.S. Application Data

(63) Continuation of application No. PCT/JP03/09206, filed on Jul. 18, 2003.

(30) Foreign Application Priority Data

Jul. 24, 2002 (JP) ..... 2002-215486
Jul. 24, 2002 (JP) ..... 2002-215487

(51) Int. Cl.
*A61G 7/015* (2006.01)

(52) U.S. Cl. ..... 5/619; 5/618; 5/613; 5/942

(58) Field of Classification Search ..... 5/619, 5/616, 617, 618, 613, 942
See application file for complete search history.

(56) References Cited

U.S. PATENT DOCUMENTS

| | | | | | |
|---|---|---|---|---|---|
| 12,944 | A | * | 5/1855 | Daniels | 5/619 |
| 137,596 | A | * | 4/1873 | Clinton et al. | 5/619 |
| 238,799 | A | * | 3/1881 | Morgan | 5/619 |
| 1,775,547 | A | * | 9/1930 | Bayer | 5/618 |
| 2,284,470 | A | * | 5/1942 | Comper et al. | 5/602 |
| 2,522,018 | A | * | 9/1950 | Blackman | 5/607 |
| 3,318,596 | A | * | 5/1967 | Herzog | 5/619 |
| 3,411,766 | A | * | 11/1968 | Lanigan | 5/619 |
| 4,084,274 | A | * | 4/1978 | Willis et al. | 5/609 |
| 4,103,170 | A | * | 7/1978 | Spradlin | 378/179 |
| 4,287,620 | A | * | 9/1981 | Zur | 5/615 |
| 4,658,450 | A | * | 4/1987 | Thompson | 5/607 |
| 4,805,249 | A | * | 2/1989 | Usman et al. | 5/619 |
| 4,893,365 | A | * | 1/1990 | Justice | 5/613 |
| 4,940,286 | A | * | 7/1990 | Nguti | 297/423.37 |
| 5,125,122 | A | * | 6/1992 | Chen | 5/618 |
| 5,303,437 | A | * | 4/1994 | Hung | 5/613 |
| 5,392,479 | A | * | 2/1995 | Liao | 5/618 |
| 5,479,665 | A | * | 1/1996 | Cassidy et al. | 5/613 |

(Continued)

FOREIGN PATENT DOCUMENTS

JP 50-093155 1/1977

(Continued)

*Primary Examiner*—Robert G. Santos
(74) *Attorney, Agent, or Firm*—Frishauf, Holtz, Goodman & Chick, P.C.

(57) ABSTRACT

A bedplate is disposed in a bed frame. The bedplate includes a fixed bed part, right leg-raising parts and left leg-raising parts. The fixed bed parts are secured to the bed frame. The right leg-raising parts are rotatably coupled, at one end, to one end of the fixed bed part. The left leg-raising parts are rotatably coupled, at one end, to the end of the fixed bed part. Said ends of the fixed bed part are spaced in the transverse direction of the bed frame. A bed part driving mechanism is provided on the lower surface of the bedplate. The mechanism drives one or both of the leg-raising parts of either pair, in a rising direction.

12 Claims, 13 Drawing Sheets

U.S. PATENT DOCUMENTS

| | | | | |
|---|---|---|---|---|
| 5,502,853 | A * | 4/1996 | Singleton et al. | 5/609 |
| 5,535,464 | A * | 7/1996 | Salonica | 5/604 |
| 5,608,932 | A * | 3/1997 | Hasegawa | 5/611 |
| 6,502,260 | B1 * | 1/2003 | Viljoen et al. | 5/607 |
| 2001/0000267 | A1 * | 4/2001 | Viljoen et al. | 5/600 |
| 2005/0028281 | A1 * | 2/2005 | Ooyama et al. | 5/618 |
| 2005/0160530 | A1 * | 7/2005 | Taguchi et al. | 5/618 |
| 2005/0166323 | A1 * | 8/2005 | Kawakami et al. | 5/610 |

FOREIGN PATENT DOCUMENTS

| | | | |
|---|---|---|---|
| JP | 7-42632 | U | 8/1995 |
| JP | 2000-334004 | A | 12/2000 |
| JP | 2001-333941 | A | 12/2001 |

* cited by examiner

RISING-TYPE BED APPARATUS AND MATTRESS

CROSS-REFERENCE TO RELATED APPLICATIONS

This is a Continuation Application of PCT Application No. PCT/JP03/09206, filed Jul. 18, 2003, which was published under PCT Article 21(2) in Japanese.

This application is based upon and claims the benefit of priority from the prior Japanese Patent Applications No. 2002-215486, filed Jul. 24, 2002; and No. 2002-215487, Jul. 24, 2002, the entire contents of both of which are incorporated herein by reference.

BACKGROUND OF THE INVENTION

1. Field of the Invention

The present invention relates to a rising-type bed apparatus suitable for a patient, and a mattress for use in combination with the rising-type bed apparatus.

2. Description of the Related Art

As a bed apparatus for a patient, a so-called rising-type bed apparatus has been used to help a patient whose physical power has decreased to raise his or her upper part when having a meal or on another occasion. The rising-type bed apparatus has a bedplate, a bed frame, a back-raising part, and a leg-raising part. The bedplate is provided on the upper surface of the bed frame. It is divided into a plurality of bed parts, which are arranged in a longitudinal direction of the bed frame. The back-raising part, which corresponds to the upper half of the user, is configured to be driven by a driving mechanism. When driven, the back-raising part can rise and lower.

When the back-raising part rises, raising the upper part of the user, the buttocks easily shift forwards. At the time of raising the back, the driving mechanism raises not only the back-raising part, but also the leg-raising part that opposes the user's legs. This prevents the buttocks from moving forwards.

In some of the rising-type bed apparatuses, the leg-raising part can be moved, selectively in interlock with the back-raising part. That is, the leg-raising part may be moved in interlock with the back-raising part, if necessary, or may be raised or lowered, regardless of the movement of the back-raising part.

In recent years, it has been considered that the rising-type bed apparatus in which the leg-raising part is selectively raised or lowered be used for a specific patient. For example, the use has been studied for a case where the raised legs need to be held in a lying-on-back condition if the patient who has broken or hurt otherwise the legs.

However, the leg-raising part of the conventional rising-type bed apparatus has a width equal to the length of the bed frame even though the leg-raising part can be raised or lowered, if necessary, when the back-raising part is raised or lowered. Therefore, when the leg-raising part is raised, the patient's both legs are simultaneously raised and held, even if he or she has only one leg broken or injured.

For a patient who has one leg injured, it suffices to have only that leg raised and held, but both legs are raised and held. This increases the burden on the patient's lower back. The conventional rising-type bed apparatus is not so convenient as is desired. It may give the patient a pain, depending upon the purpose of use.

An object of the present invention is to provide a rising-type bed apparatus that can hold either or both of user's legs in a raised condition, and a mattress for use in combination with the bed apparatus.

BRIEF SUMMARY OF THE INVENTION

According to the present invention, there is provided a rising-type bed apparatus comprising:

a bed frame;

a bedplate which includes a fixed bed part, a right leg-raising part and a left leg-raising part, the fixed bed part being secured to the bed frame, and the right and left leg-raising parts being rotatably coupled at one end to ends of the fixed bed part, respectively, and spaced apart in a transverse direction of the bed frame; and driving means which is provided on a lower surface of the bedplate and which is configured to drive one of the leg-raising parts or both leg-raising parts in a rising direction.

DETAILED DESCRIPTION OF THE INVENTION

One embodiment of the present invention will be described hereinafter with reference to the drawings.

Figure 1:
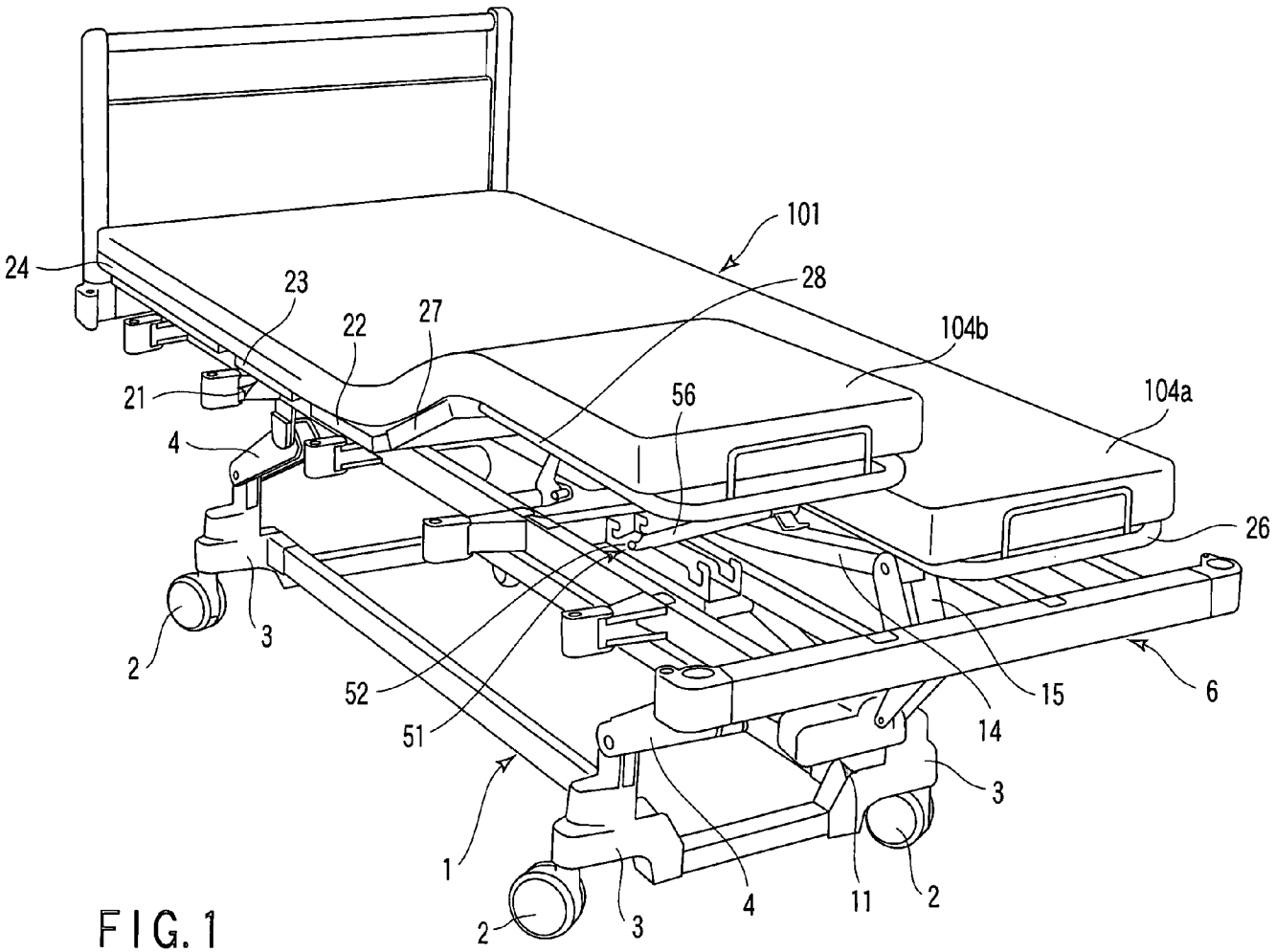
FIG. 1 is a perspective view of a rising-type bed apparatus according to one embodiment of the present invention.
Figure 2:
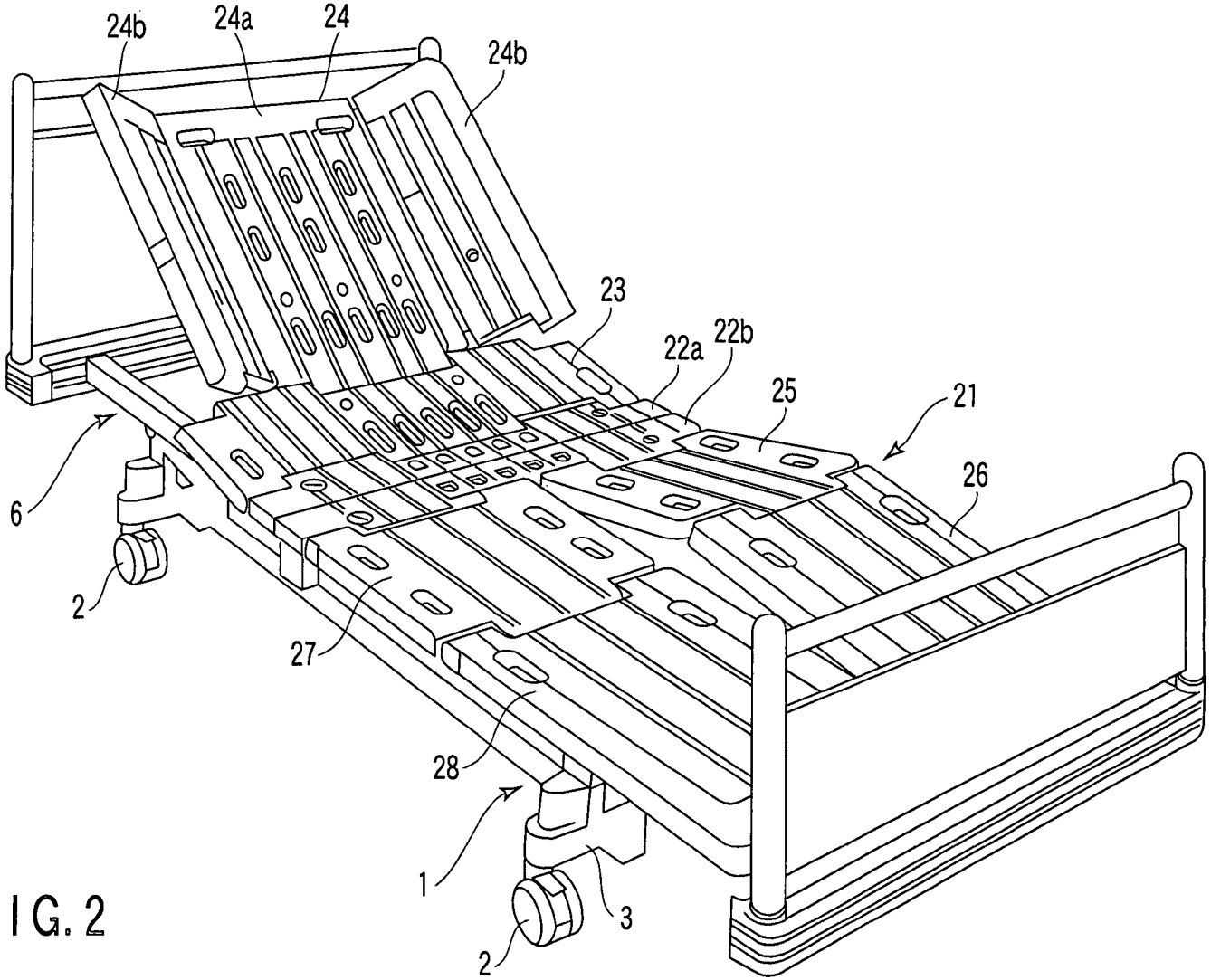
FIG. 2 is a perspective view of the bed apparatus, with no mattress placed on the bedplate.

FIGS. 1 and 2 are perspective views of a rising-type bed apparatus according to one embodiment of this invention. As FIGS. 1 and 2 show, the rising-type bed apparatus includes a base frame 1. Casters 2 are attached to the four corner parts of the base frame 1. The coupling members 3 are provided in the four corner parts of the base frame 1. The upper end part of each coupling member 3 is coupled to one end of a vertical driving arm 4.

Figure 3A:
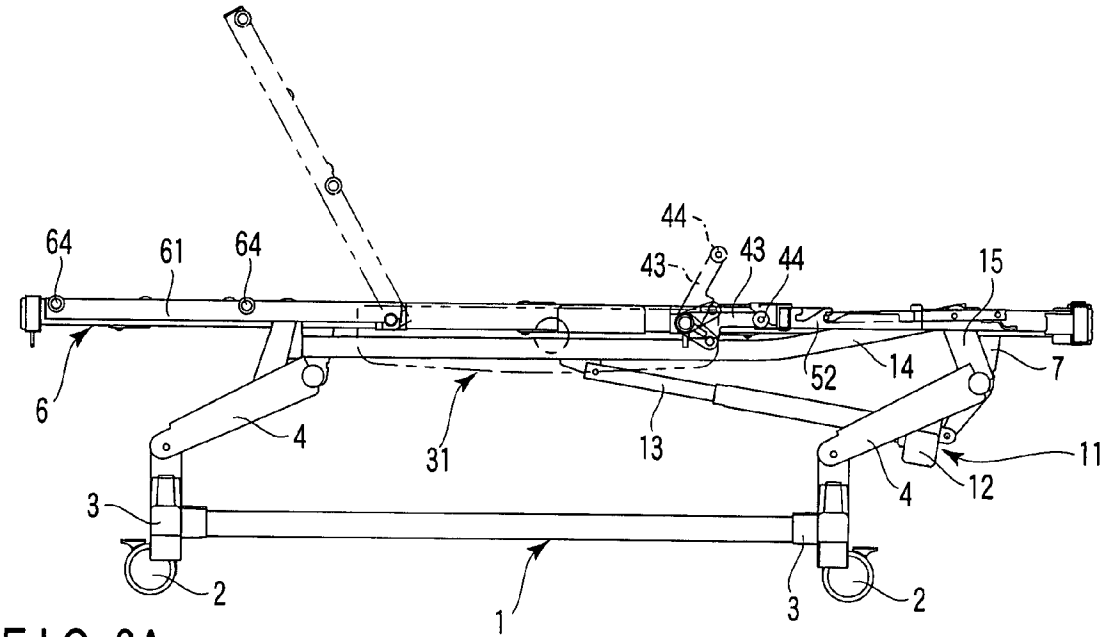
FIG. 3A is a side view of the rising-type bed apparatus, with the bedplate removed.
Figure 3B:
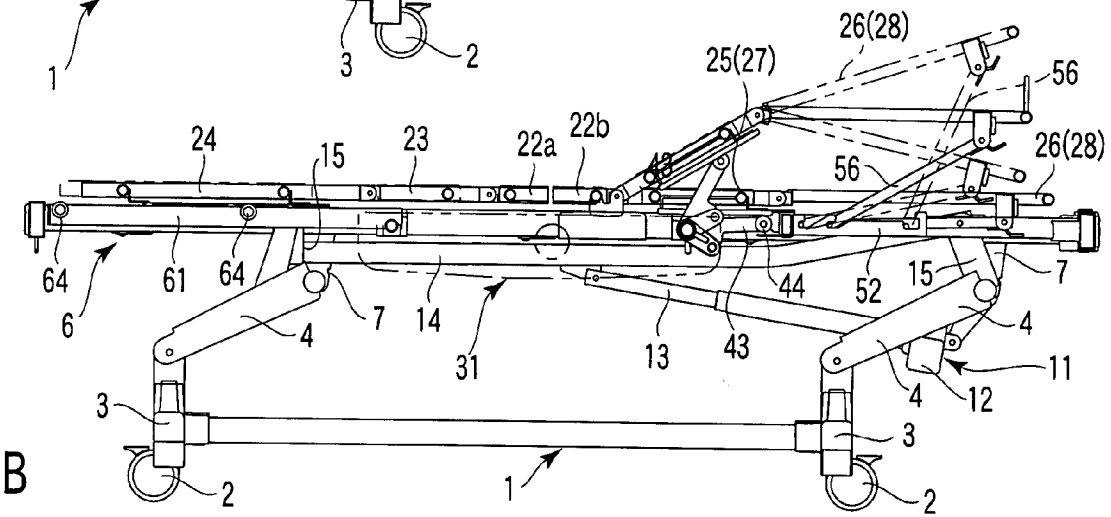
FIG. 3B is a side view of the rising-type bed apparatus, with the bedplate secured to the bed frame.
Figure 4:
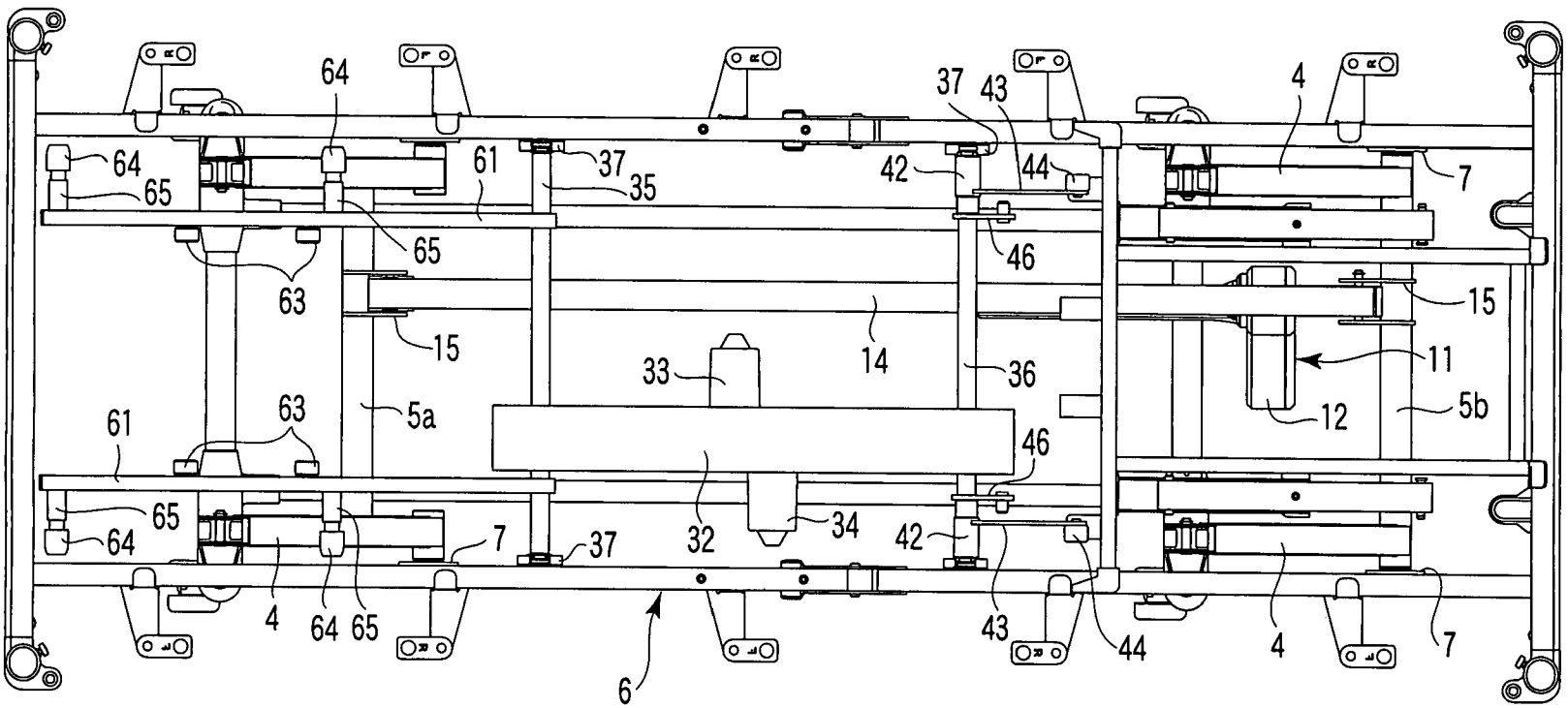
FIG. 4 is a plan view of the rising-type bed apparatus, with the bedplate removed.

As shown in FIG. 4, mid parts of a pair of vertical driving arms 4 positioned in one end part of a longitudinal direction of the base frame 1 are coupled to each other by a first link shaft 5*a*. The other end parts of a pair of vertical driving arms 4 positioned in the other end part are coupled to each other via a second link shaft 5*b*. The other ends of each pair of vertical driving arms 4 are coupled to link pieces 7 (shown in FIGS. 3A, 3B). The link pieces 7 extend vertically from the inner surface of the base frame 6, at the ends thereof, and are spaced in the longitudinal direction of the base frame 6.

The second link shaft 5*b* is attached to a vertical driving device 11. The vertical driving device 11 includes a driving source 12 and a driving shaft 13. The drive source 12 can drive the driving shaft 13 forward or backward in the axial direction by the driving source 12.

An interlocking rod 14 is pivotally coupled, at one end by a bracket 15 to that part of the first link shaft 5*a* which is middle in the axial direction, and at the other end by a bracket 15 to that part of the second link shaft 5*b* which is middle in the axial direction. The distal end of the of the driving shaft 13 is pivotally coupled to the middle part of the interlocking rod 14.

Therefore, the interlocking rod 14 is driven when the driving source 12 of the vertical driving device 11 drives the driving shaft 13 in the axial direction. The vertical driving arms 4 are thereby rotated, with one end coupled to the coupling member 3 acting as a fulcrum and with the other end rising, by the use of first link shaft 5*a* and the second link shaft 5*b*. Attached to the other end of the vertical driving arm 4, the base frame 6 is driven to rise.

Figure 5:
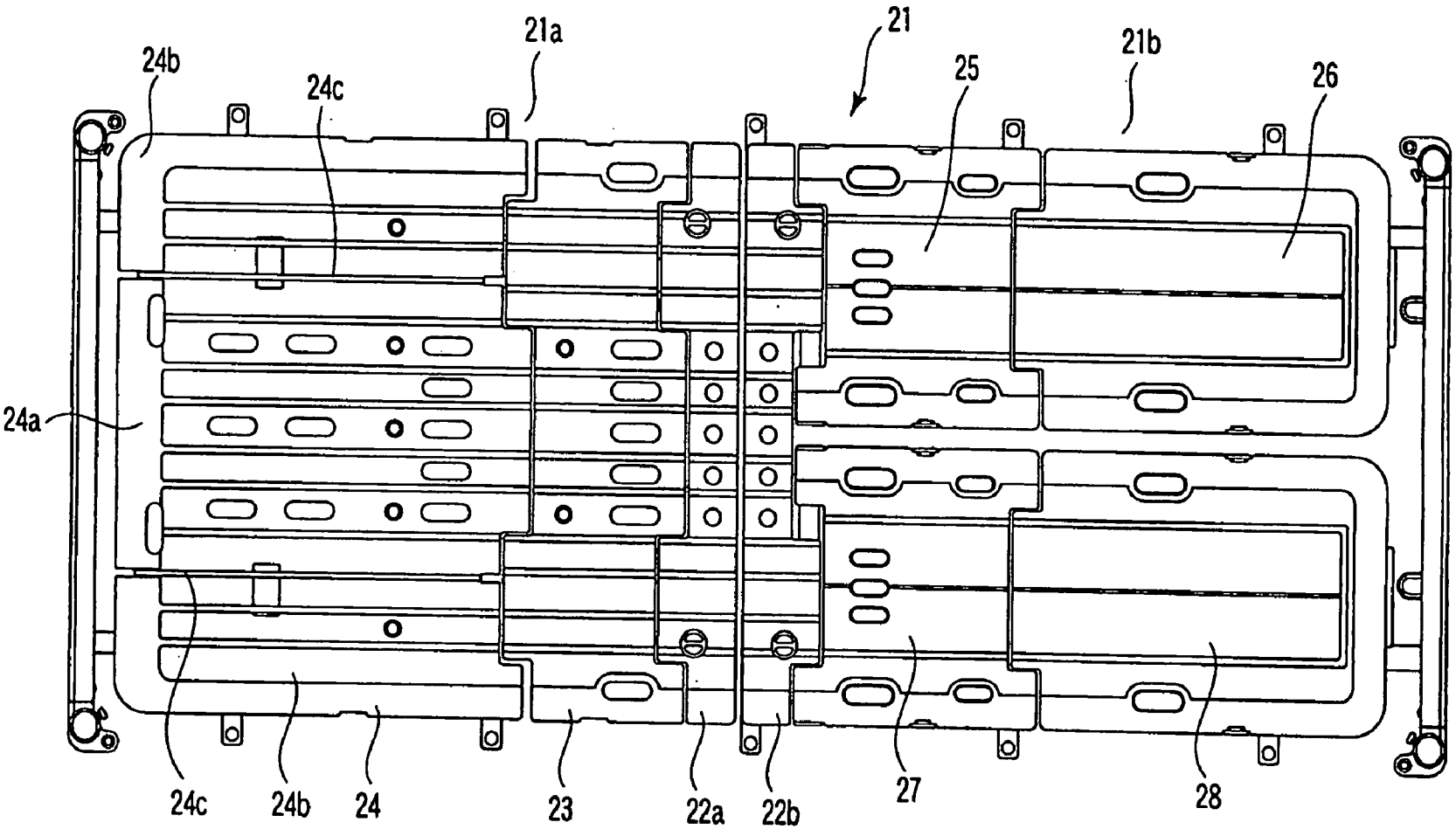
FIG. 5 is a plan view of the rising-type bed apparatus, showing the bedplate.

A bedplate 21 is mounted on the bed frame 6. As FIG. 5 shows, the bedplate 21 includes a first unit 21*a* and a second unit 21*b*. Each unit is divided into a plurality of bed parts. The first unit 21*a* comprises a first fixed bed part 22*a* removably fixed to that part of the bed frame 6 which is middle in the longitudinal direction. One end of this first fixed bed part 22*a* is rotatably coupled to a lower back-raising part 23, which is rotatably coupled to a back-raising part 24.

The second unit 21*b* includes a second fixed bed part 22*b*. The second fixed bed part 22*b* is removably secured to the other end of the first fixed bed part 22*a*, in the vicinity of the other end of the first fixed bed part 22*a* and at that part of the bed frame 6 which is middle in the longitudinal direction. One end part of the second fixed bed part 22*b* is successively rotatably coupled to a first left leg-raising part 25 and a second left leg-raising part 26. The second fixed bed part 22*b* is rotatably coupled, at the other end, to a first right leg-raising part 27. The first leg-raising part 27 is rotatably coupled to a second right leg-raising part 28.

As shown in FIG. 5, the back-raising part 24 has a middle part 24*a* and a pair of back parts 24*b*. The back parts 24*b* are coupled to the ends of the middle part 24*a* and spaced part in the transverse direction of the middle part 24*a*. The back parts 24*b* can rotate upwards. The middle part 24*a* and back parts 24*b* are integrally formed by, for example, blow synthetic resin molding.

Once the middle part 24*a* and the back parts 24*b* have been integrally formed, thin parts 24*c* couple the middle part 24*a* to those edges of the back parts 24*b*, which are at upper side in a thickness direction. Thus, the back parts 24*b* are coupled to the middle part 24*a* and can rotate upwards only.

The bed parts of the bedplate 21, other than the first and second fixed bed parts 22*a* and 22*b* are driven by a bed part driving mechanism 31. When driven by the mechanism 31, they can be raised or lowered. As shown in FIG. 4, this bed part driving mechanism 31 includes a main body 32. The body part 32 is shaped like an elongated box, extending in the longitudinal direction of the bed frame 6. A first driving source 33 is provided on one surface of the main body 32. A second driving source 34 is provided on the other side surface of the main body 32.

A first driving shaft 35 is provided at one end of the main body 32. A second driving shaft 36 is provided at the other end of the main body 32. The first and second driving shafts 35 extend at right angles to the longitudinal direction of the main body 32. The driving shafts 35 and 36 are rotatably supported, on the opposite inner surfaces of the bed frame 6, which are spaced apart in the transverse direction of the bed frame 6. That is, the driving shafts 35 and 36 are so supported by bearings 37*a* shown in FIG. 7. When driven by the first driving source 33, the first driving shaft 35 rotates. When driven by the second driving source 34, second driving shaft 36 rotates.

As shown in FIG. 4, a pair of back-raising arms 61 have their proximal ends fixed to the opposite ends of the first driving shaft 35. A pair of back raising rollers 63 are provided on the inner surface of a free end part of each back-raising arm 61 and spaced apart at a predetermined interval. A pair of push-up rollers 64 are provided on the outer surface and rotatably mounted on pivotable shafts 65.

Figure 15:
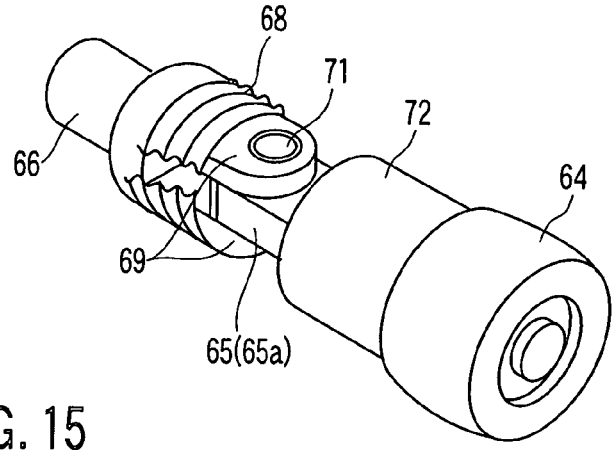
FIG. 15 is a perspective view of the bend shaft provided and a push-up roller mounted on the bend shaft.
Figure 16:
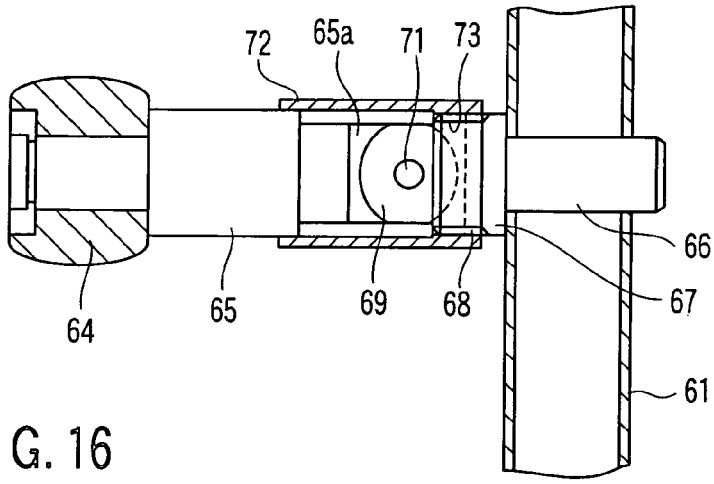
FIG. 16 is a partially sectional plan view showing the bend shaft so held not to be bent further.
Figure 17:
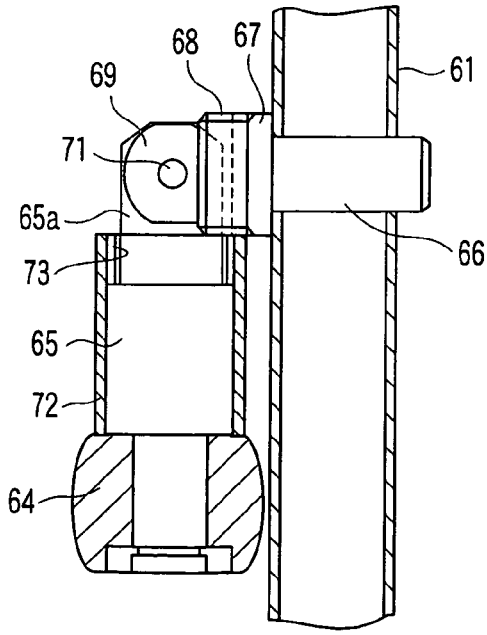
FIG. 17 is a partially sectional plan view illustrating the bend shaft that is bent.

As shown in FIGS. 15 to 17, a pivotable shaft 65 is attached to the back-raising arm 61 and can be bent. More precisely, an attaching pin 66 extends through the arm 61 in the transverse direction thereof and is secured to the back-raising arms 61. A male screw 68 is formed on the head part 67 of the attaching pin 66, which protrudes from the side of the back-raising arms 61. Furthermore, a pair of attaching pieces 69 (only one is shown) are formed on the head part 67. The proximal end of the pivotable shaft 65 has a flat part 65*a*. The flat part 65*a* is interposed between the attaching pieces 69 and attached to a pin 71.

A collar 72 is slidably mounted on the middle part of the pivotable shaft 65. A push-up roller 64 having a diameter larger than the collar 72 is rotatably mounted on the distal end part of the pivotable shaft 65. A female screw 73 is cut in the inner peripheral surface of the proximal end of the collar 72.

When the collar 72 is slid on a pivotable shaft 65 as shown in FIG. 17, the pivotable shaft 65 can bend with respect to the attaching pin 66, using the pin 71 as fulcrum. When the collar 72 is slid on an attaching pin 66 as shown in FIG. 16, while the female screw 73 of the proximal remains meshed with the male screw 68 of the attaching pin 66, the collar 72 holds the pivotable shaft 65, not allowing the shaft 65 to bend or to rotate around the pin 71.

Figure 13:
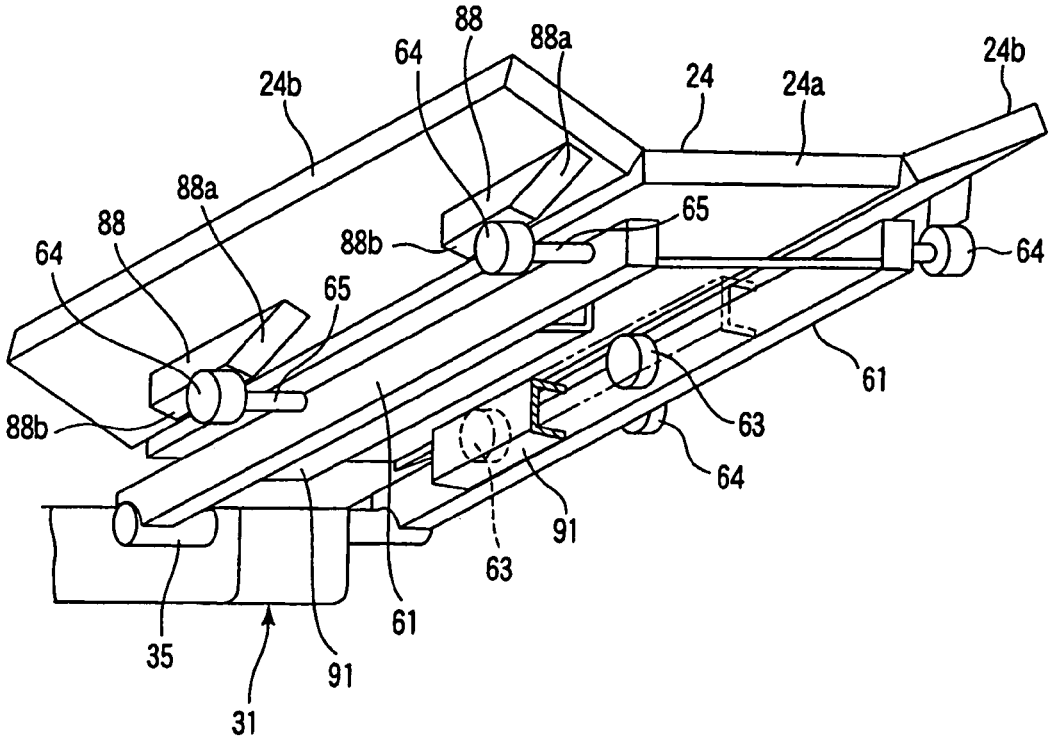
FIG. 13 is a perspective view showing the back-raising part held in a raised position.

As FIG. 13 shows, a pair of protrusions 88 are integrally formed with bedplate 21. They are provided on the lower surfaces of a pair of back parts 24*b* of the back-raising part 24 and extend in the longitudinal direction of the bedplate 21, More precisely, the protrusions 88 are formed on the lower surfaces of a pair of back parts 24*b* of the back-raising part 24. During the molding of the back-raising part 24, the protrusions 88 are located at one end corresponding to the proximal end of rotation of the back-raising part 24 and at the other end part corresponding to the distal end of rotation of the rotation.

The protrusion 88 has an inclined part 88*a* and a flat part 88*b*. The inclined part 88*a* gradually becomes higher toward the distal end of the back-raising part 24. The flat part 88*b* is continuous to the inclined part 88*a* and its height remains unchanged over the total length.

Figure 14B:
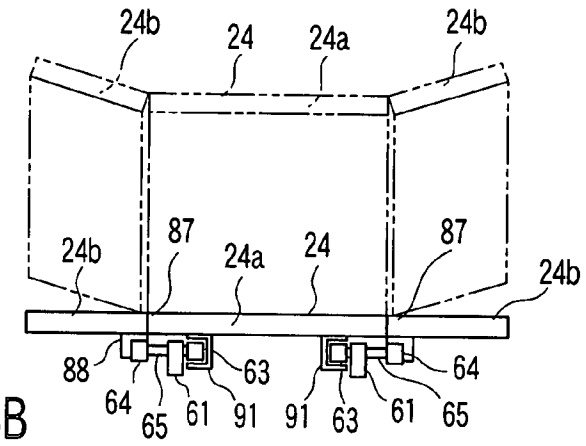
FIGS. 14A to 14D are views depicting the back-raising part held in a raised position.
Figure 14D:
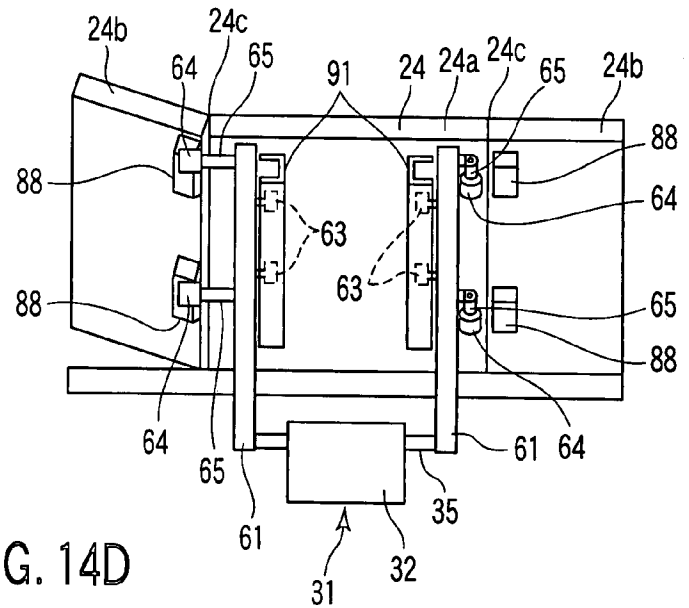
Figure 14A:
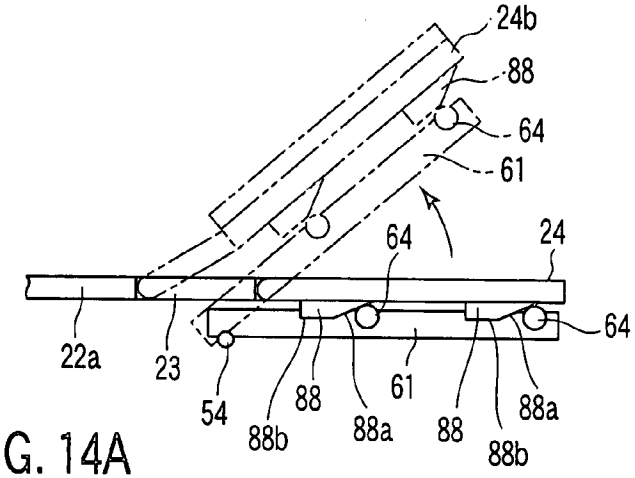

As long as the back-raising arm 61 remains horizontal, the push-up rollers 64 on the outer surface of the back-raising arms 61 contact the lower ends of the inclined parts 88*a* of the protrusions 88, as is indicated by the solid line in FIG. 14A. When the back-raising arms 61 rotate, assuming a rising position, the arm presses the inclined part 88*a*, while moving to the flat part 88*b*.

The protrusions 88 are made of synthetic resin and integrally molded with the back parts 24*b* of the back-raising part 24. Instead of the protrusions 88, strip-shaped member, bent in the form of letter L, may be secured to the lower surface of the back part 24*b*.

Substantially U-shaped guide rails 91 are arranged along the longitudinal direction, on those opposite parts of the lower surface of the back middle part 24*a* of the back-raising part 24 which are spaced apart in the transverse direction. The back raising rollers 63 disposed on the inner surface of the back-raising arm 61 are set in rolling engagement with this guide rail 91.

The axes of the back raising roller 63 and push-up roller 64, both provided on the inner and outer surfaces of the back-raising arm 61, are set at substantially the same level as shown in FIG. 14B. Accordingly, the middle part 24*a* and the back parts 24*b* extend substantially horizontally while the back-raising part 24 remains in a horizontal position.

Thus, when the first driving shaft 35 is rotated or driven by the first driving source 33 of the bed part driving mechanism 31, rotating the back-raising part 24 in the rising direction, the push-up rollers 64 on the back-raising arms 61 come into rolling-contact with the inclined parts 88*a* of the protrusions 88 of the back parts 24*b*. Hence, the rollers 64 moves move from the inclined parts 88*a* to the flat parts 88*b*.

The inclined parts 88*a* have their surfaces gradually rising from the lower surfaces of side parts 84*b*. Therefore, the push-up rollers 64 push up the back parts 24*b* when the back-raising arms 61 rotate. As a result, the back parts 24*b* are bent toward the upper surface of the bedplate 21, around the back middle part 24*a* that acts as the fulcrum.

When the back parts 24*b* are bent, the mattress 101 laid on the bedplate 21 is elastically bent by the back parts 24*b*. (The mattress 101 will be described later.)

The bent back parts 24*b* on the sides of the upper half of the user who is lying on the back on the mattress 101, when or after the back is raised. This prevents the user from falling sideways even if the user cannot hold himself or herself.

The push-up rollers 64 are provided on the bending shafts 65 that are provided on the back-raising arms 61 and can be bent. The push-up rollers 64 push up the back parts 24*b* of the back-raising part 24, whenever necessary.

Once the pivotable shafts 65 have been pivoted, the back parts 24*b* of the back-raising part 24 can be raised without being bent upwards. Therefore, the user can bend the back parts 24*b* of the back-raising part 24 if he or she wants.

Figure 14C:
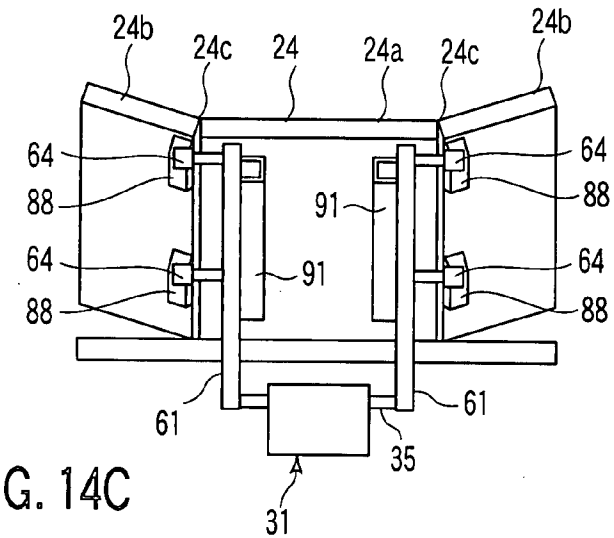

When a person helps the user to raise the back, only the push-up roller 64, which is provided on one back-raising arm 61 that touches the side of that person, can be bent together with the pivotable shaft 65. The roller can therefore contact the protrusion 88. The person can therefore support the user. FIG. 14C shows the case where both back parts 24*b* that are bent. FIG. 14D shows the case where only one back part 24*b* is bent.

The back-raising arm 61 has the back raising roller 63 and push-up roller 64. The protrusion 88 that includes the inclined part 88*a* and flat part 88*b* is disposed on the lower surface of the back part 24*b* of the back-raising part 24.

Moreover, when the back-raising arms 61 are rotated in the rising direction when necessary, the back raising rollers 63 push up the back middle part 24*a* of the backraising part 24. In addition, the push-up rollers 64 push the protrusions 88, ultimately bending the back parts 24*b*.

Thus, the back-raising arms 61 can raise the back-raising part 24, together with the back parts 24*b*. Since no link mechanism exclusively for use in bending the back parts 24*b* is required, the bed apparatus is simple in structure, having less components than otherwise.

As FIG. 4 and FIGS. 8A to 8C show, cylindrical bodies 42 are rotatably attached to the opposite end parts of the second driving shaft 36, which are spaced apart in the transverse direction. An operation lever 41 extends in the diametrical direction, at the outer surface of each of the cylindrical bodies 42. The lever 41 is used to slide the cylindrical body 42 along the axial direction of the second driving shaft 36. A leg-raising arm 43 is fixed, at its proximal end, to the outer surface, deviating from the operation lever 41 by a predetermined angle in a peripheral direction. A leg-raising roller 44 is rotatably provided on the free end part of the leg-raising arm 43.

Figure 9A:
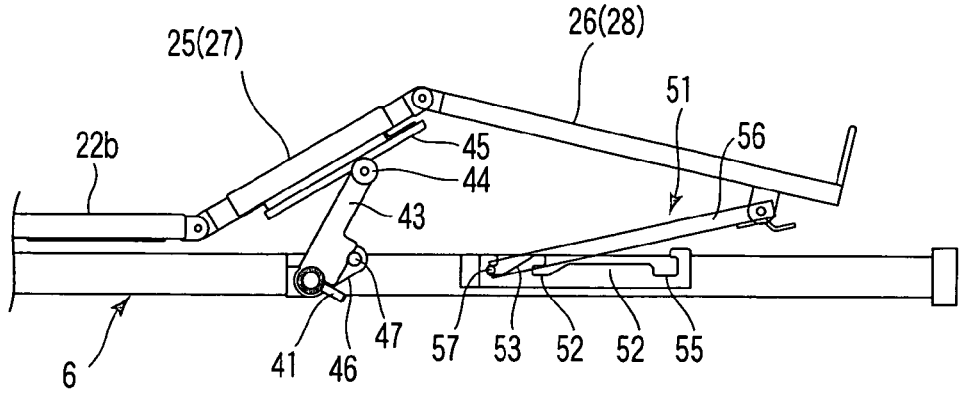
FIGS. 9A to 9C are views illustrating the second leg-raising part held at different angles.
Figure 9B:
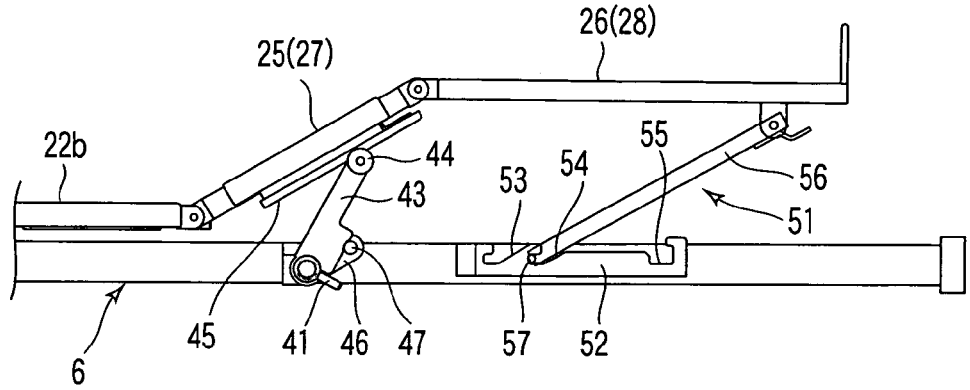
Figure 9C:
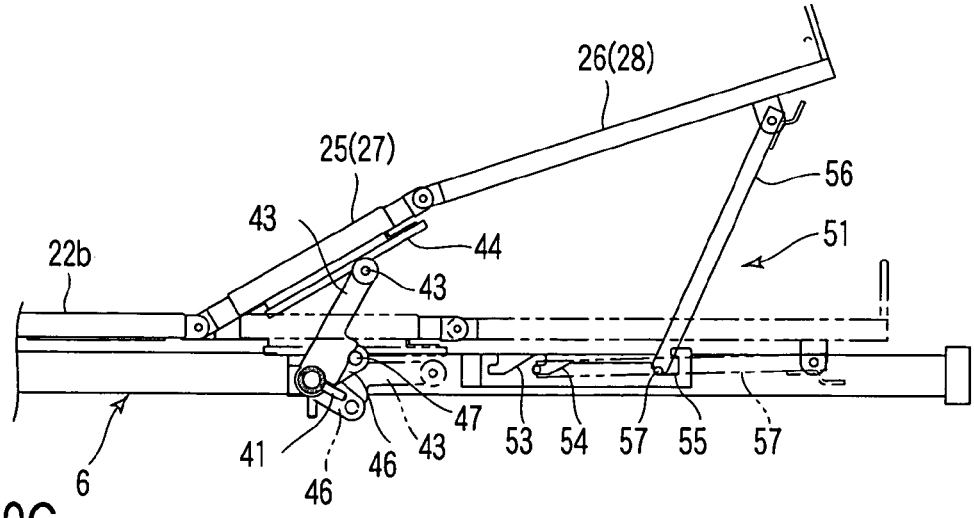

As shown in FIGS. 9A to 9C, the leg-raising roller 44 on one leg-raising arm 43 abuts on a guide rail 45 that is provided on the lower surface of the first left leg-raising part 25. The leg-raising roller 44 on the other leg-raising arm 43 abuts on the guide rail 45 that is provided on the lower surface of the first right leg-raising part 27.

Note that a pair of leg-raising arms 43 is engaged with a holding member (not shown) that is disposed on the bed frame 6. The holding member prevents the arms 43 from rotating downwards, maintaining the arms 43 in a substantially horizontal position as shown in FIG. 8A.

The proximal end of an interlocking member 46 is fixed to the second driving shaft 36, in the vicinity of each cylindrical body 42. As FIG. 8A shows, the interlocking member 46 is attached at such an angle that the member is positioned below the leg-raising arm 43 that is held substantially horizontally. An engagement shaft 47, or an engagement part, protrudes toward the leg-raising arm 43 from the side of the free end part of the interlocking member 46.

An engagement concave part 48 is made in the proximal end of the leg-raising arm 43. The engagement concave part 48 receives the engagement shaft 47 when the leg-raising arm 43 is slid closer to the interlocking member 46.

Figure 8A:
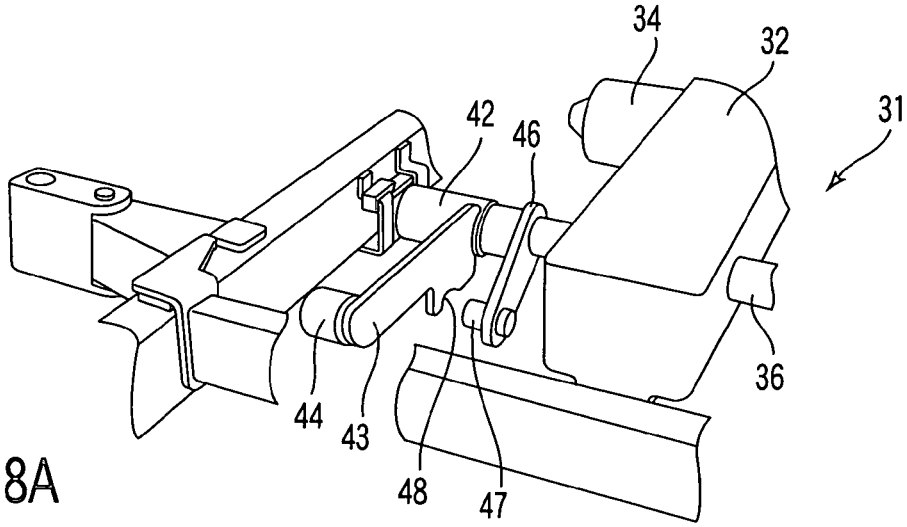
FIGS. 8A to 8C are perspective views showing a leg-raising arm and an interlocking member.

As shown in FIG. 8A, the interlocking member 46 is rotated in the rising direction only even when the second driving shaft 36 is rotated or driven, with the leg-raising arm 43 spaced apart from the interlocking member 46. The leg-raising arm 43 does not rotate; it is held in a horizontal state.

Figure 8B:
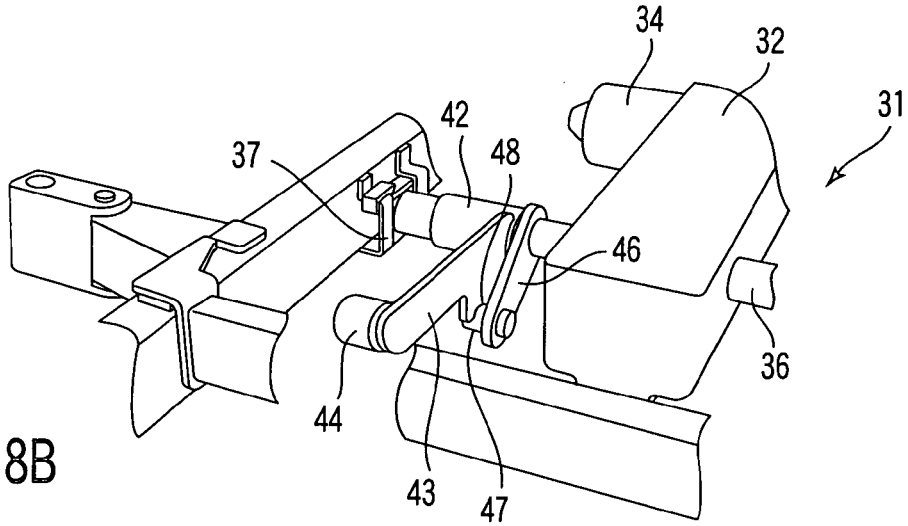
Figure 8C:
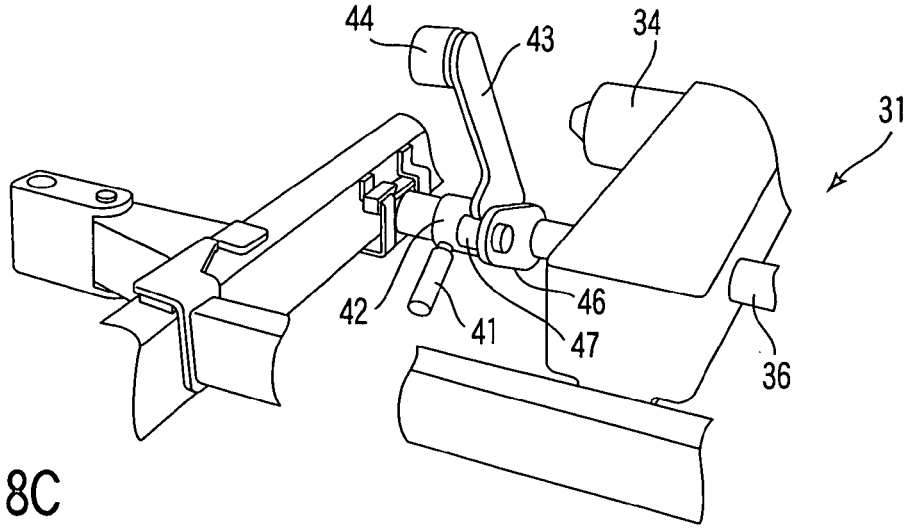

As shown in FIG. 8B, the leg-raising arm 43 is slid, and the second driving shaft 36 is rotated or driven in a state in which the engagement concave part 48 is engaged with the engagement shaft 47. Then, as shown in FIG. 8C, the leg-raising arm 43 is interlocked with the rotation of the interlocking member 46 in the rising direction. Accordingly, the first left and right leg-raising parts 25, 27 can be driven in the rising direction.

Figure 7:
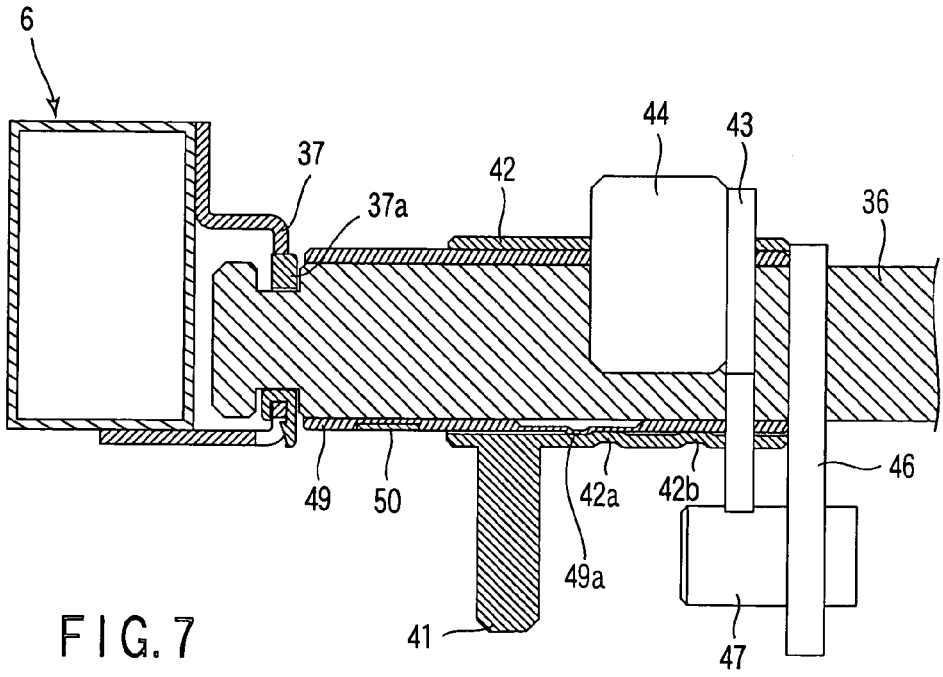
FIG. 7 is a sectional view of one end part of the second driving shaft.

As FIG. 7 shows, sleeves 49 (only one is shown) made of resin are attached to the opposite end parts of the second driving shaft 36. The cylindrical bodies 42 fixed to the proximal ends of the leg-raising arms 43 are slidably attached around the sleeves 49. The sleeve 49 has a receiving part 49*a*. The receiving part 49*a* protrudes from the outer peripheral surface and can be elastically displaced inwards in the diametric direction. The sleeves 42 has first convex part 42*a* and second convex part 42*b*. The convex parts 42*a* and 42*b* are elastic and removably attached to the receiving parts 49*a*.

When the cylindrical body 42 is slid along the sleeve 49, the first and second convex parts 42*a* and 42*b* are removed from or attached to the receiving part 49*a*. Accordingly, the cylindrical body 42 is elastically held with respect to the sleeve 49, unable to slide, in a position where the engagement concave part 48 of the leg-raising arm 43 is engaged with the engagement shaft 47 of the interlocking member 46 as shown in FIGS. 7 and 8B. The cylindrical body 42 is elastically held also in a position where the engagement concave part 48 is disengaged from the engagement shaft 47 as shown in FIG. 8A.

As shown in FIG. 7, a colored seal 50 is provided on the outer surface of one end part of the sleeve 49 in the axial direction. The colored seal 50 is exposed when the engagement concave part 48 of the leg-raising arm 43 receives the engagement shaft 47 of the interlocking member 46. The seal is covered when the engagement concave part 48 is disengaged from the engagement shaft 47. Therefore, the position of the leg-raising arm 43 that has slid can be determined in accordance with whether the colored seal 50 is exposed.

When the first left and right leg-raising parts 25 and 27 are rotated in the rising direction, the second left and right leg-raising parts 26 and 28 are interlocked with these rotations. They can be held at predetermined angles to the first left and right leg-raising parts 25 and 27 by a holding mechanism 51.

Figure 6:
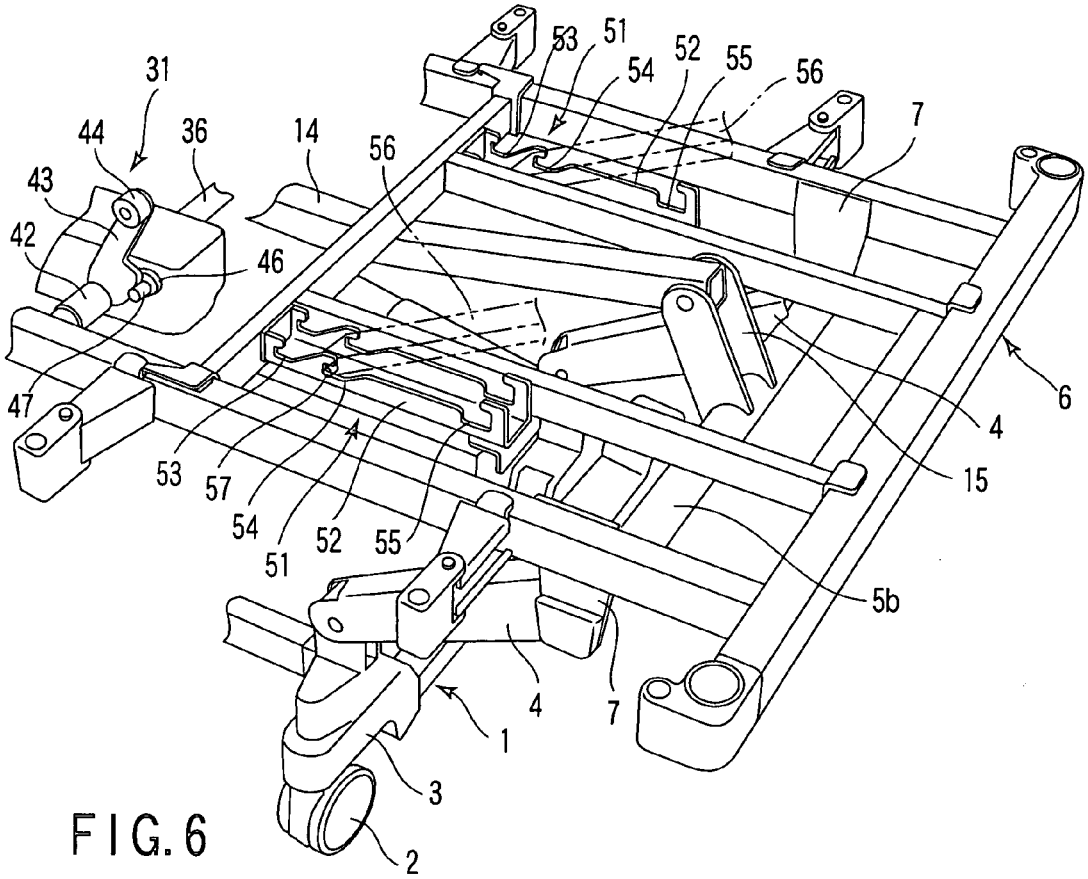
FIG. 6 is a perspective view of one end part, showing the holding mechanism of the bed frame.

As shown in FIG. 6, the holding mechanism 51 includes a pair of holding members 52, which extend in the longitudinal direction and are provided at the end parts of the bed frame 6 spaced apart in the transverse direction. The holding member 52 is a plate member. The member 52 is bent, having a substantially U-shaped cross section. A first holding groove 53 and a second holding groove 54 are cut in the opposite side walls spaced apart in the longitudinal direction. Each of the grooves 53 and 54 is made in one end part of the side wall. A third holding groove 55 is made in the other end part of the side wall.

As FIGS. 9A to 9C show, a support rod 56 is attached, at one end, to the lower surface of the other end of each of the second left and right leg-raising parts 26 and 28. The leg-raising parts 26 and 28 are attached, at one end, to the first left and right leg-raising parts 25 and 27. On the other end of the support rod 56, a support shaft 57 is provided as an engagement member and is detachably engaged with the holding grooves 53 to 55.

Figure 10A:
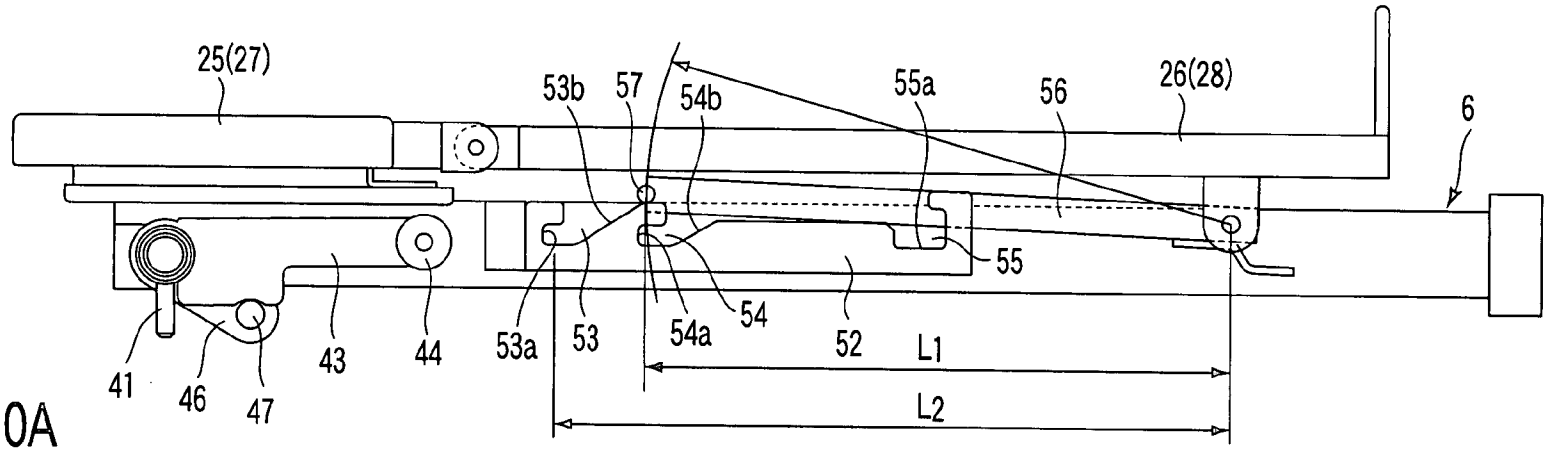
FIG. 10A is a view showing the support shaft engaged with a first holding groove to recline the second leg-raising part.
Figure 10B:
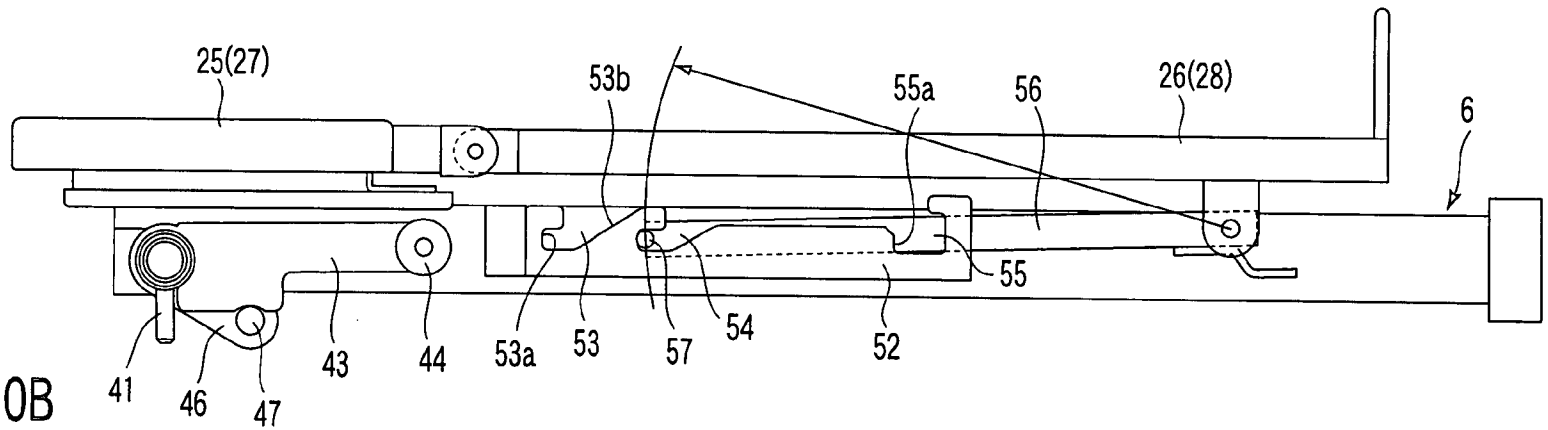
FIG. 10B is a view depicting the support shaft engaged with a second holding groove to recline the second leg-raising part.

As FIGS. 10A and 10B depict, the first holding groove 53 is defined by a U-shaped hook part 53*a* and an inclined surface 53*b*. The inclined surface 53*b* is continuous, at one end, to the hook part 53*a* and is inclined, gradually rising toward the second holding groove 54. The inclined surface 53*b* is continuous, at the other end, to the upper end surface of the holding member 52.

The second holding groove 54 is defined by a hook part 54*a* and an inclined surface 54*b*, in the same manner as the first holding groove 53. The third holding groove 55 is defined by a hook part 55*a*.

As FIG. 9A shows, the first left and right leg-raising parts 25 are 27 are driven in the rising direction, with the support shaft 57 engaged with the first holding groove 53 of the holding member 52. The second left and right leg-raising parts 26 and 28, which are interlocked with the first left and right leg-raising parts 25 and 27, rise at such an angle that the other end is positioned below one end that is coupled to the first left and right leg-raising parts 25 and 27.

As shown in FIG. 9B, the first left and right leg-raising parts 25, 27 are driven in the rising direction, while the support shaft 57 remains in the second holding groove 54. The second left and right leg-raising parts 26 and 28, which are interlocked with the first left and right leg-raising parts 25 and 27, rise at such an angle that the other end is positioned below one end coupled to each of the first left and right leg-raising parts 25 and 27. That is, the first left and right leg-raising parts 26 and 28 are held in a substantially horizontal position.

As FIG. 9C depicts, to raise the second left and right leg-raising parts 26 and 28 at such an angle such that the other end is higher than one end coupled to the first left and right leg-raising parts 25 and 27, the first left and right leg-raising parts 25 and 27 are driven in the rising direction while the support shaft 57 of the support rod 56 remain engaged with the first holding groove 53 or the second holding grooves 54. The second left and right leg-raising parts 26 and 28 are raised as shown in FIG. 9A or 9B. Subsequently, the support shaft 57 comes out of the first holding groove 53 or second holding groove 54 and comes into engagement with the third holding groove 55. Then, the second left and right leg-raising parts 26 and 28 can be raised at such an angle that the other end is higher than other end coupled to the first left and right leg-raising parts 25 and 27.

To lay the second left and right leg-raising parts 26 and 28 horizontally, the support shaft 57 is detached from the third holding groove 55 and is engaged with the first or second holding groove 53, 54. Then, the first left and right leg-raising parts 25 and 27 may be driven in a laying direction.

When the support shaft 57 is engaged with any of the first to third holding grooves 53 to 55, the angles formed by the second left and right leg-raising parts 28 with respect to the first left and right leg-raising parts 25 and 27 can be changed.

Note that the support shaft 57 disengages from the hook part 53*a* of the first holding groove 53 when the leg-raising parts 25 to 28 are rotated from the position shown in FIG. 9A to a substantially horizontal position shown in FIG. 10A. Thus, the support shaft 57 rises on the inclined surface 53*b* to the upper end of the surface 53*a*.

The second left and right leg-raising parts 28 are driven in the rising direction after the support shaft 57 has risen to the upper end of the inclined surface 53*b*. Then, the support shaft 57 moves downwards along the inclined surface 53*b* and come into engagement with the hook part 53*a* of the first holding groove 53. Therefore, the second left and right leg-raising parts 28 can be held at an angle shown in FIG. 9A.

That is, as shown in FIG. 10A, the distance $L_1$ between the support shaft 57 and the attached end of the support rod 56 is shorter than the distance $L_2$ between the hook part 53*a* and the attached end, so long as the first and second left and right leg-raising parts 25 to 28 are laid substantially horizontally.

Therefore, the support shaft 57 rides on the inclined surface 53*b* when the raised leg-raising parts 25 to 28 are laid substantially horizontally. Nonetheless, the bed parts are driven in the rising direction, the support shaft lowers along the inclined surface 53*b* to engage with the hook part 53*a*. Therefore, even with $L_1<L_2$, the second left and right leg-raising parts 28 can be automatically held at predetermined angles.

As shown in FIG. 10B, the distance $L_1$ between the support shaft 57 and the attached end of the support rod 56 is substantially equal to the distance between the hook part 54*a* of the second holding groove 54 and the attached end, so long as the support shaft 57 is engaged with the second engagement groove 54 as shown in FIG. 9B. The second left and right leg-raising parts 28 are therefore driven while the support shaft 57 remains engaged with the hook part 54*a* of the second engagement groove 54.

Figure 11A:
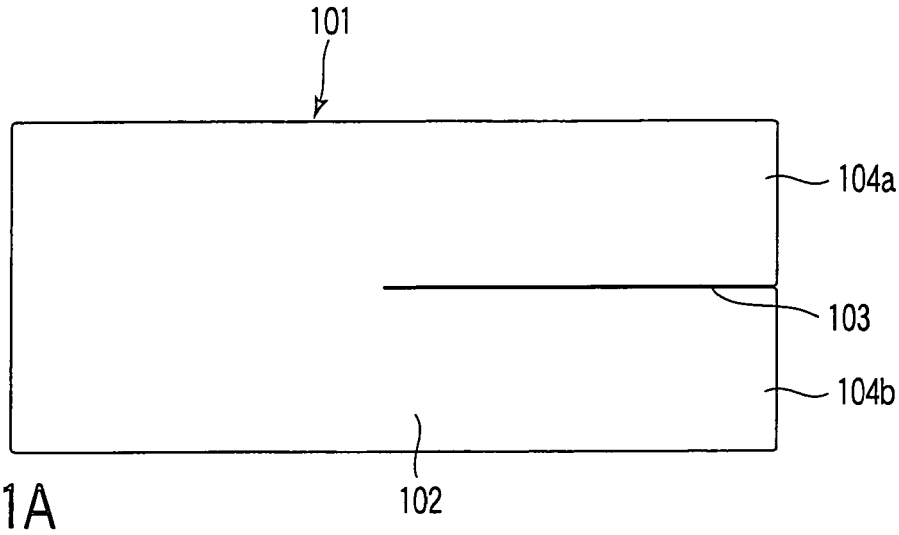
FIG. 11A is a plan view of a mattress.
Figure 11B:
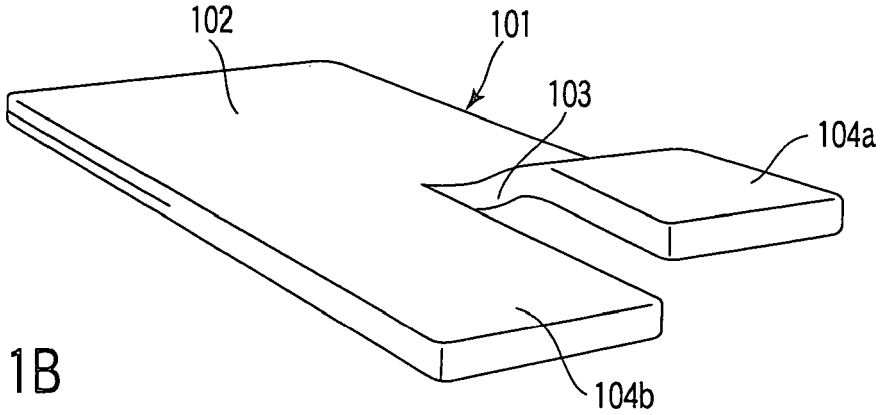
FIG. 11B is a perspective view showing one part of the mattress that is deformed when the leg-raising part is raised.

The mattress 101 shown in FIGS. 11A and 11B are mounted on the upper surface of the bedplate 21. The mattress 101 comprises a body (not shown) of elastic material, such as urethane foam, and a bag-shaped exterior fabric 102 covering the body. One end part of the mattress 101, which corresponds to the first left and right leg-raising parts 25 and 27 and second left and right leg-raising parts 26 and 28, is divided, along a cutting line 103, into a first or right part 104*a* and a second or left part 104*b*.

Figure 12:
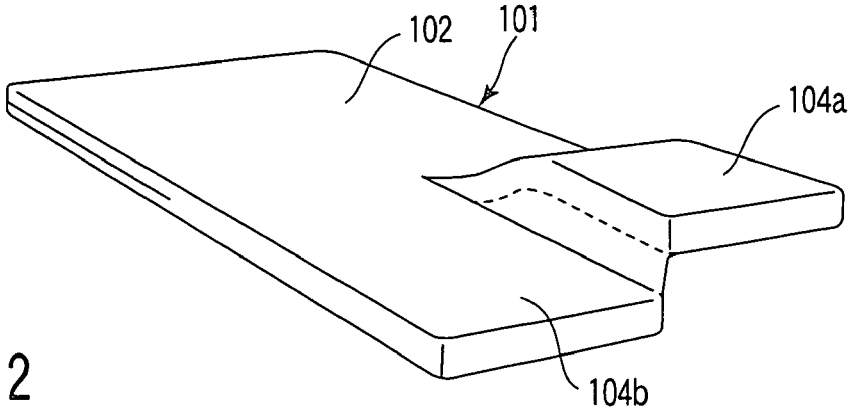
FIG. 12 is a perspective view illustrating a modification of the mattress.

FIG. 12 shows a modification of a mattress 61. The exterior fabric 102 of the mattress 101 is formed by cloth having elasticity. Therefore, for first (right) and second (left) parts 104*a* and 104*b*, only urethane foam stored in the exterior fabric 102 is cut, and the exterior fabric 102 is not cut.

Moreover, the exterior fabric 102 expands when the first part 104*a* or the second part 4*b* is lifted by the left or right first and second leg-raising parts 25 to 28.

How to use the rising-type bed apparatus described above will be described.

The first driving source 33 of the bed part driving mechanism 31 is operated, driving or rotating drive the first driving shaft 35, The back-raising arms 61 are rotated in the rising direction as shown by the chain line in FIG. 3A. Accordingly, the back-raising part 24 of the bedplate 21 rises, and the lower back-raising part 23 is raised in interlock with the back-raising part 24. Therefore, the user lying on his back on the mattress 101 has his or her upper half raised.

The back-raising part 24 is composed of the back middle part 24*a* and the back parts 24*b*. The back parts 24*b* are coupled to the opposite ends of the back middle part 24*a* and can be rotated upwards. The protrusions 88 extend from the lower surfaces of a pair of back parts 24*b*. The push-up rollers 64 are provided on the back-raising arms 61 and abut on the protrusions 88.

Accordingly, the push-up rollers 64 contacts and presses the inclined parts 88*a* of the protrusions 88 when the back-raising arms 61 are driven in the rising direction. The flat parts 88*b* is therefore shifted from the inclined parts 88*a*.

When the push-up rollers 64 presses the flat parts 88*b* of the protrusions 88, the back parts 24*b* are inclined. Therefore, the user can be inhibited from falling sideways even if the user does not have any physical power for keeping his or her upper half body in a raised position. This is because the inclined back parts 24*b* holds the upper half part of the user who is lying on his back on the mattress 101.

It should be noted that that only one of the back parts 24*b* can be inclined when the back-raising part 24 is raised.

When the second driving source 34 of the bed part driving mechanism 31 is operated, driving or rotating the second driving shaft 36, the first left leg-raising part 25 or first right let-raising part 27 of the bedplate 21, or both can be raised.

To raise the first left leg-raising part 25 or the first right leg-raising part 27, one leg-raising arm 43 positioned on the first left or right leg-raising part side is slid, approaching the interlocking member 46 as shown in FIG. 8B, from the position shown in FIG. 8A. In this case, the engagement shaft 47 on the interlocking member 46 comes into engagement with the concave part 48.

When the second driving source 34 rotates the second driving shaft 36, the leg-raising arm 3 is driven by the interlocking member 46 and rotates the leg-raising arm 3 rotate in the raising direction. The leg-raising roller 44 drives one leg-raising part, for example the first left leg-raising part 25, in the raising direction. The holding mechanism 51 therefore holds the second left leg-raising part 26, which is coupled to the first left leg-raising part 25, at the predetermined angle to the first left leg-raising part 25.

Only the first right leg-raising part 27 may be driven in the raising direction when the second driving shaft 36 is rotated instead of the first left leg-raising part 25. In this case, the leg-raising arm 43 for raising the first right leg-raising part 27 is slid along the second driving shaft 36 until the engagement concave part 48 is engaged with the engagement shaft 47 of the interlocking member 46.

The second leg-raising arm 43 for raising the first left leg-raising part 25 is slid until the engagement concave part 48 disengages from the engagement shaft 47 of the interlocking member 46. When the second driving source 34 drives or rotates the second driving shaft 36, the leg-raising arm 43 drives only the first right leg-raising part 27 in the raising direction.

Thus, the first left leg-raising part 25 or the first right leg-raising part 27 can be driven in the raising direction. In addition, both of these first left and right leg-raising parts 25 and 27 can be driven in the raising direction. In this case, a pair of leg-raising arms 43 for driving the first left leg-raising part 25 and the first right leg-raising part 27 in the raising direction are slid until the engagement concave parts 48 engage with the engagement shaft 47 of the interlocking member 46. Since the leg-raising arms 43 are interlocked with the rotation of the second driving shaft 36, the first left and right leg-raising parts 25 and 27 can be driven to be raised or laid together.

In this embodiment, the bed part driving mechanism 31, leg-raising arm 43, and interlocking member 46 constitute driving means for raising, laying or driving the left leg-raising parts 25 and 26 and/or the right leg-raising parts 27 and 28.

When the first left and right leg-raising parts 25 and 27 are driven in the raising direction, the second left and right leg-raising parts 26 and 28 move in the raising direction, in interlock with the leg-raising parts 25 and 27. The holding mechanism 51 can hold the second left and right leg-raising parts 26 and 28 at the predetermined angles.

That is, the support shaft 57 on the other end of the support rod 56, one end of which is attached to the free end of each of the second left and right leg-raising parts 26 and 28, is engaged with any of the first to third holding grooves 53 to 55 formed in the holding members 52. Accordingly, it is possible to change the angles, at which the second left and right leg-raising parts 26 and 28 are held with respect to the first left and right leg-raising parts 25 and 27.

More precisely, when the support shaft 57 is engaged with the first holding groove 53 as shown in FIG. 9A, the second left and right leg-raising parts 26 and 28 can be held, with the other end (i.e., free end) positioned lower than one end coupled to the first left and right leg-raising parts 25 and 27. When the support shaft 57 is engaged with the second holding groove 54 as shown in FIG. 9B, the second left and right leg-raising parts 26 and 28 can be held in a substantially horizontal position.

When the support shaft 57 is engaged with the third holding groove 55, as shown in FIG. 9C, the second left and right leg-raising parts 26 and 28 can be held in a state in which the other end is higher than one end.

With the rising-type bed apparatus described above, the leg bed part for lifting up the user's legs is divided into the first and second left leg-raising parts 25 and 26 and first and second right leg-raising parts 27 and 28. The right leg-raising parts or the left leg-raising parts, or both groups of leg-raising parts, may be rotated upwards.

Therefore, the user can lie on his back, with only on leg lifted up or both legs are lifted up.

Additionally, the second left and right leg-raising parts 26 and 28 can hold the user's leg parts that are below the knees, while the holding mechanism 51 is changing the angles to the first left and right leg-raising parts 25 and 27 stepwise.

Therefore, the user can have one leg or both legs lifted up. Furthermore, the bending angles of the legs can be changed. Therefore, it is possible to hold the user's legs in such a condition as minimizing the burden on the user, or in a condition optimal in view of the disease the user is suffering.

The mattress 101 laid on the upper surface of the bedplate 21 is divided into the first part 104*a* and the second part 104*b* at a midpoint in the transverse direction of the bedplate 21, along the cutting line 103. The first part 104*a* corresponds to the first and second left leg-raising parts 25 and 26, and the second part 104*b* corresponds to the first and second right leg-raising parts 27, 28.

Therefore, only one part of the mattress 101, which corresponds to the leg-raising parts that are raised as shown in FIG. 11B or 12, can be smoothly deformed even when these leg-raising parts are driven in the raising direction. Therefore, the user can have his or her one leg held securely or smoothly in a raised condition.

The present invention is not restricted to the above-described embodiment. Rather, various modifications can be made. As indicated above, a pair of leg-raising arms and the interlocking member are disposed on the second driving shaft that is rotated or driven by the second driving source, to rotate the left or right leg-raising part to a raised position or a horizontal position. Instead, the leg-raising arms and the interlocking member may be attached to two driving shafts, respectively. In this case, the driving shafts may be rotated or driven by two driving sources, to rotate the left leg-raising part and the right leg-raising part, respectively.

Moreover, each right/left leg-raising part may comprise only one leg-raising part, not the first leg-raising part attached to the fixed bed part and the second leg-raising part attached to the first leg-raising part as in the embodiment described above.

As has been described, the leg-raising part of the bedplate is divided into right and left leg-raising parts positioned at the end parts of the bed frame, respectively, and spaced apart in the transverse direction of the bed frame. One leg-raising part or both leg-raising parts can be driven in the rising direction.

Therefore, the user can have one leg or both legs held in a raised position, as he or she wants.

What is claimed is:

1. A rising-type bed apparatus comprising:

a bed frame;

a bedplate which includes a fixed bed part secured to the bed frame, and a right leg-raising part and a left leg-raising part which are adjacent in a transverse direction of the bed frame, and each of which is rotatably coupled at one end thereof to the fixed bed part;

a driving mechanism which is provided on a lower surface of the bedplate and which is configured to drive at least one of the leg-raising parts in a rising direction;

a back-raising part including a back middle part rotatably coupled to the fixed bed part and a pair of back parts rotatably coupled to the back middle part on opposite sides of the back middle part in the transverse direction;

a back raising mechanism which is disposed on a lower surface of the back-raising part and which is drivable to incline at least one of the pair of back parts of the back-raising part by a predetermined angle with respect to the back middle part, when the back-raising part is driven in a rising direction by the driving mechanism;

wherein the back raising mechanism comprises:

at least one back-raising arm drivable to be raised and lowered;

at least one back raising roller, disposed on the back-raising arm, to drive the back middle part of the back-raising part to raise and lower the back middle part; and at least one push-up roller, disposed on the back-raising arm, to selectively incline a corresponding one of the pair of back parts of the back-raising part by the predetermined angle with respect to the back middle part when the back-raising part is driven in a rising direction by the driving mechanism.

2. The rising-type bed apparatus according to claim 1, wherein a mattress is mounted on the bedplate, and a part of the mattress that corresponds to the pair of legraising parts is divided at a midpoint into two parts which are adjacent in a transverse direction of the bedplate.

3. The risingtype bed apparatus according to claim 1, wherein the driving mechanism comprises:

a driving shaft which is driven to rotate;

a pair of legraising arms including respective base ends that are rotatably and slidably disposed on parts of the driving shaft corresponding to the pair of leg-raising parts; and a pair of interlocking members, each of which includes a base end fixed on the driving shaft in a vicinity of a corresponding leg-raising arm and which is disengageably engagable with the corresponding leg-raising arm to interlock the leg-raising arm with rotation of the driving shaft to raise the corresponding leg-raising part by the leg-raising arm.

4. The rising-type bed apparatus according to claim 1, wherein each of the right and left leg-raising parts comprises:

a first leg-raising part which includes a first end that is rotatably coupled to the fixed bed part and which is driven in the rising direction by the driving mechanism; and a second leg-raising part which includes one end that is rotatably coupled to a second end of the first leg-raising part, and which is held at a predetermined angle with respect to the first leg-raising part by a holding mechanism when the first leg-raising part is driven in the rising direction by the driving mechanism.

5. The rising-type bed apparatus according to claim 4, wherein the holding mechanism comprises:

a holding member in which a plurality of holding grooves are arranged at predetermined intervals along a longitudinal direction; and a support rod including a first end that is rotatably coupled to a lower surface of the second leg-raising part and a second end that includes an engagement member that is selectively engageable with the plurality of holding grooves to hold the second leg-raising part at the predetermined angle with respect to the first leg-raising part when the first leg-raising part is rotated to be driven in the rising direction.

6. The rising-type bed apparatus according to claim 5, wherein the plurality of holding grooves include:

a first holding groove that is engaged with the engagement member to hold the second leg-raising part in an inclined state in which a free end of the second leg-raising part that is not coupled to the first leg-raising part is positioned below a horizontal state; and a second holding groove that is engaged with the engagement member to hold the second leg-raising part substantially horizontally.

7. The rising-type bed apparatus according to claim 6, wherein the plurality of holding grooves include a third holding groove that is engaged with the engagement member to hold the second leg-raising part in an inclined state in which the free end of the second leg-raising part is higher than the end coupled to the first leg-raising part.

8. The rising-type bed apparatus according to claim 6, wherein the holding member comprises an inclined surface to guide the engagement member from the first holding groove when the second leg-raising part, with the support rod rotatably coupled thereto, is rotated to a substantially horizontal position, and to guide the engagement member from a position disengaged from the first holding groove to engage with the first holding groove when the second leg-raising part is rotated from the substantially horizontal position to a raised position as the first leg-raising part is raised.

9. A rising-type bed apparatus comprising:

a bed frame;

a bedplate which includes a fixed bed part secured to the bed frame and a back-raising part rotatably coupled to the fixed bed part, said back-raising part including a back middle part and a pair of back parts rotatably coupled to the back middle part on opposite sides of the back middle part in a transverse direction thereof; and a back raising mechanism which is disposed on a lower surface of the back-raising part and which is drivable to raise and lower the back-raising part and to incline at least one of the pair of back parts of the back-raising part by a predetermined angle with respect to the back middle part;

wherein the back raising mechanism comprises:

at least one back-raising arm drivable to be raised and lowered;

at least one back raising roller which is disposed on the back-raising arm and which drives the back middle part of the back-raising part to raise and lower the back middle part; and at least one push-up roller which is disposed on the back-raising arm and which selectively inclines a corresponding one of the pair of back parts of the back-raising part by the predetermined angle with respect to the back middle part when the backraising part is raised.

10. The rising-type bed apparatus according to claim 9, further comprising a protrusion disposed on a lower surface of each back part of the pair of back parts, and the corresponding push-up roller roll-contacts the protrusion to incline the back part by the predetermined angle with respect to the back middle part, when the back-raising arm on which the push-up roller is provided rises.

11. The rising-type bed apparatus according to claim 9, wherein the push-up roller is movable between a non-contact state and a contact state with respect to the protrusion.

12. The rising-type bed apparatus according to claim 9, wherein the pushup roller is rotatably disposed on a pivotable shaft pivotably disposed on the back-raising arm, and the push-up roller is constituted to be incapable of contacting the protrusion by pivoting the pivotable shaft, when a side part of the back-raising part is not tilted.

* * * * *